US012044024B2

(12) United States Patent
Glowacki et al.

(10) Patent No.: US 12,044,024 B2
(45) Date of Patent: Jul. 23, 2024

(54) EXPANDABLE BASE

(71) Applicants: Michael Glowacki, Borken (DE); Timo Wedershoven, Borken (DE)

(72) Inventors: Michael Glowacki, Borken (DE); Timo Wedershoven, Borken (DE)

( * ) Notice: Subject to any disclaimer, the term of this patent is extended or adjusted under 35 U.S.C. 154(b) by 139 days.

(21) Appl. No.: 17/614,603

(22) PCT Filed: May 29, 2020

(86) PCT No.: PCT/DE2020/100455
§ 371 (c)(1),
(2) Date: Nov. 29, 2021

(87) PCT Pub. No.: WO2020/244707
PCT Pub. Date: Dec. 10, 2020

(65) Prior Publication Data

US 2022/0228395 A1 Jul. 21, 2022

(30) Foreign Application Priority Data

Jun. 3, 2019 (DE) ..... 10 2019 114 893.6

(51) Int. Cl.
*E04H 12/22* (2006.01)
*A45B 9/04* (2006.01)
*A45B 25/00* (2006.01)

(52) U.S. Cl.
CPC ..... *E04H 12/2246* (2013.01); *A45B 9/04* (2013.01); *A45B 25/00* (2013.01); *A45B 2025/003* (2013.01)

(58) Field of Classification Search
CPC ... E04H 12/2246; E04H 12/2238; A45B 9/04; A45B 25/00; A45B 2025/003; A45B 2023/0012; F16M 11/22; E01F 9/654; E01F 9/688; A63B 2225/605; A63B 2225/62
See application file for complete search history.

(56) References Cited

U.S. PATENT DOCUMENTS 3,800,735 A 4/1974 Simpson
4,899,771 A * 2/1990 Wilkinson ..... A45B 9/04 135/84
5,410,838 A 5/1995 O'Leary et al.
5,779,215 A 7/1998 DeMasi
2002/0183166 A1* 12/2002 Chen ..... A63B 71/0054 482/29

(Continued)

FOREIGN PATENT DOCUMENTS

CN 205848925 U 1/2017
EP 1559853 A1 3/2005

(Continued)

OTHER PUBLICATIONS

English Abstract for FR2497919 A1, Jul. 16, 1982.

(Continued)

*Primary Examiner* — Bradley Duckworth
(74) *Attorney, Agent, or Firm* — CAHN & SAMUELS, LLP

(57) ABSTRACT

A base having an expandable central chamber which, in the expanded state, forms a sleeve with an end open to the top for receiving a rod, a base element and at least one expandable connecting chamber connecting the central chamber to the base element.

22 Claims, 6 Drawing Sheets

(56) References Cited

U.S. PATENT DOCUMENTS

| | | | | |
|---|---|---|---|---|
| 2003/0064861 | A1* | 4/2003 | Chen | A63B 5/11<br>482/27 |
| 2011/0259381 | A1* | 10/2011 | Adams | A45B 9/04<br>135/82 |
| 2015/0000716 | A1* | 1/2015 | LeAnna | E04H 12/2284<br>248/514 |

FOREIGN PATENT DOCUMENTS

| | | | |
|---|---|---|---|
| EP | 1925763 | A2 | 5/2008 |
| FR | 2497919 | A1 | 7/1982 |
| GB | 2478274 | A | 9/2011 |

OTHER PUBLICATIONS

International Preliminary Report on Patentability, Dec. 16, 2021.
English Abstract of CN205848925U, Jan. 4, 2017.

* cited by examiner

EXPANDABLE BASE

This U.S. patent application is a national stage application of PCT/DE2020/100455 filed on 29 May 2020 and claims priority of German patent document 10 2019 114 893.6 filed on 3 Jun. 2019, the entireties of which are incorporated herein by reference.

BACKGROUND AND SUMMARY OF INVENTION

The present invention relates to an expandable base.

Bases, which are often designated as umbrella stands, may be used, for example in order to hold sunshades or small flagpoles for advertising banners.

Bases are known, which are heavy and take up a lot of space, so that transport is possible only with difficulty.

Mobile bases are additionally known, which may be brought into a transport state, in which they take up less volume. Mobile bases of this type generally have fold-out feet or ground spikes. The models with fold-out feet are designed to be weighted down with separately transported concrete slabs, while the models with fold-out ground spikes are time-consuming to fix in the ground.

A further disadvantage of the known mobile bases is that, although they may be brought into a transport state, they are still unwieldy and difficult to transport, because even in the transport state, they represent a relatively narrow yet still long, cuboidal object.

The object of the invention is to provide a base which overcomes the disadvantages known from the prior art. The object of the invention may thereby be seen as, among others, providing a base which is easy to transport and is usable on any type of ground surface.

To solve this problem, a base is provided comprising an expandable central chamber which, in the expanded state, forms a sleeve with an end open at the top for receiving a rod, a base element, and at least one expandable connecting chamber which connects the central chamber to the base element.

In the non-use state, i.e., in the non-expanded state, the stand is very compact and lightweight. In the use state, i.e., in the expanded state, the stand may accommodate a rod, like an umbrella base, and hold the same upright. In order to guarantee a secure base, the base element may be weighted down, for example, with water, sand, or other weight elements, which are available at the assembly site.

The chambers of the base are expandable, This means that the volume of the chambers may be changed from a low volume, in the non-expanded state, to a larger volume, in the expanded state.

In one embodiment, the expandable chambers are filled or partially filled with an expandable filler, like a foam, wherein the filler is compressed in the non-expanded state, and expanded in the expanded state. When using filled or partially filled chambers, the chambers may be configured as air-permeable or air-impermeable. An air-permeable chamber is understood to be a chamber whose sheath is air-permeable. An air-impermeable chamber is understood to be a chamber whose sheath is air-impermeable. However, when using an air-impermeable chamber, at least one opening, in particular a valve, is present, through which air may arrive in the chamber or into the filler.

According to the invention, mixed forms are likewise provided, in which one or more chambers with filler are combined with one or more chambers without filler in one base.

The central chamber and/or the at least one connecting chamber is/are preferably an air-tight, i/e., air-impermeable chamber. In the presence of more than one connecting chamber, preferably one connecting chamber may be designed as an airtight chamber, particularly preferably all connecting chambers are designed as airtight chambers.

In one advantageous embodiment, the central chamber and/or the at least one connecting chamber may be expanded through inflation. In the presence of more than one connecting chamber, one, multiple, or all connecting chambers may thus be configured to be inflatable.

The expandable base preferably does not comprise any rigid material, the expandable base particularly preferably comprises plastic, in particular PVC.

In the expanded state, the central chamber forms a sleeve with an end open at the top for receiving a rod. In the expanded state, the central chamber thus forms an elongate sleeve with a vertical longitudinal axis, into whose upwardly open end, a rod, stick, tube, or other rod-like object may be inserted.

In the expanded state, the upwardly open end of the central chamber preferably forms an opening which, when viewed from the top, forms a slot, a circle, an oval, or a polygon, particularly preferably a triangle, square, pentagon, or hexagon. When viewed from the top, the sides of the polygon preferably form indentations, preferably semicircular indentations, in the direction of the center of the opening. Due to these indentations, rods with diverse cross-sectional shapes and sizes may be securely held.

The base has at least one connecting chamber, which connects the central chamber to the base element. In one advantageous embodiment of the invention, the inflatable base comprises at least two, preferably at least three, expandable connecting chambers, which each connect the central chamber to the base element. The connecting chambers preferably form transverse struts, which extend from the central chamber, preferably form the upper third of the central chamber, to the base element.

The connecting chambers are preferably arranged distributed circumferentially about the central chamber. The connecting chambers are particularly preferably arranged distributed regularly, circumferentially about the central chamber. The connecting chambers effect that, in the expanded state, the central chamber may not tilt in the direction that is approximately opposite to the connecting chamber. Thus, it is particularly advantageous if the connecting chambers are distributed circumferentially about the central chamber, so that tilting of the central chamber in any direction may be prevented.

In the expanded state, the connecting chambers may thus form transverse struts which connect the central chamber to the base element. In the case that only one or only two connecting chambers are used, it is nevertheless advantageous if the one or the two connecting chambers are not designed as thin transverse struts, but instead as broad elements, so that the central chamber is surrounded for the most part circumferentially by the one or the two connecting chambers, and a tilting of the central chamber may be prevented.

The connecting chambers may additionally be designed as partitions, wherein this type of partition preferably has the shape of a triangle, which extends with a first side to the base element, preferably to the floor mat, and with a second side up to the central sleeve. Due to these partitions, the base element may be loaded with different weight elements separately from one another.

In one advantageous embodiment of the invention, the expandable central chamber and the at least one expandable connecting chamber define with one another an angle in the range from 20° to 60°, preferably in the range from 30° to 50° in the expanded state. An embodiment of this type offers good stability while retaining a compact shape of the base in the expanded state.

In one advantageous embodiment of the invention, the at least one expandable connection chamber in the expanded state is at least half as long as the expandable central chamber in the expanded state.

The base element is connected to the at least one connecting chamber, and may be weighted down with one or more weight elements. Sand or water in particular are considered to be weight elements. The connecting chambers are preferably arranged spaced apart from one another so that the weight elements may be applied between two adjacent connecting chambers onto the base element. When using only one connecting chamber, this preferably has an opening for applying a weight element onto the base element.

In one advantageous embodiment of the invention, the base element comprises a floor mat, in particular a ground sheet.

In one advantageous embodiment of the invention, the end of the central chamber opposite the open end is connected to the base element, in particular to the floor mat. The expandable central chamber is preferably sealed below by the base element, preferably by the floor mat.

The base element preferably comprises an expandable base chamber which particularly preferably forms a base ring in the expanded state. A base ring is to be understood as a ring, which preferably has a circular cross section. The base chamber may be designed as circular, when viewed from above; however, the base chamber may also form a polygon, in particular a square, when viewed from above. In the expanded state, the base chamber preferably forms a circular base ring, when viewed from above, whose axis of rotation extends axially to the longitudinal axis of the central chamber. The floor mat and the base chamber are preferably connected to one another. The floor mat preferably covers the entire area which is circumferentially delimited by the base chamber. The base chamber preferably forms the external conclusion of the base element when viewed from above. The base chamber preferably directly contacts the ground surface in the use state.

The base chamber may be filled with a filler or unfilled, like the central chamber and the at least one connecting chamber.

One, multiple, or all of the chambers, selected from the group made of the central chamber (2), connecting chambers (3, 4, 5), and the base chamber (8), form(s) airtight chamber(s).

In one advantageous embodiment of the invention, one, multiple, or all of the chambers, selected from the group made of the central chamber (2), connecting chambers (3, 4, 5), and the base chamber (8), may be expanded by inflation.

All chambers are preferably designed as air-impermeable chambers, which may be inflated.

The floor mat is preferably connected water-tight to the expandable base chamber. In this type of configuration, the base element may be filled with water as the weight element up to the upper edge of the base chamber.

In one advantageous embodiment of the invention, the floor mat has a valve, through which water may be admitted into the space delimited by the base chamber and floor mat, and/or discharged.

The floor mat used may, however, also have recesses in the form of holes, or may be designed as strips which extend from the lower end of the central chamber to the base chamber. In this type of configuration, the floor may be weighted down with other weight elements, but not with water.

The base element preferably comprises a cover, which represents an upper boundary of the base element. The base element thus forms a cavity, which is delimited below by the floor mat, laterally by the base chamber, and above by the cover. The cover preferably has a valve, through which water may be admitted into the cavity and/or discharged.

In one advantageous embodiment of the invention, the base element consists of a floor mat and base chamber; in a further advantageous embodiment, the base element consists of a floor mat, base chamber, and cover.

In one advantageous embodiment of the invention, the at least one expandable connecting chamber connects the expandable central chamber to the expandable base chamber. In a top view, the connecting chambers preferably extend radially from the central chamber to the base chamber.

In the expanded state, the connecting chambers are preferably designed as tubular, preferably circularly tubular, and extend from the central chamber to the base chamber.

One, multiple, or all expandable chambers may be designed as separate chambers or as continuous chambers, so that they may be expanded, in particular, inflated together.

The expandable base chamber and the at least one expandable connecting chamber preferably form a continuous chamber. In this type of configuration, these chambers may be expanded together, by which means the expandable central chamber is already vertically aligned in the non-expanded state and may receive a rod.

The expandable central chamber preferably forms a separate chamber. In this type of configuration, an insertion of a rod into the preferably already vertically aligned, expandable central chamber in the non-expanded state is simplified due to lower friction. The central chamber may subsequently be expanded in order to guarantee a secure holding of the rod.

The expandable base preferably comprises at least one valve per separate chamber, which is provided in order to be expanded, to admit air into the chamber.

The invention is subsequently explained again with reference to the figures.

DETAILED DESCRIPTION OF THE DRAWINGS

Figure 1:
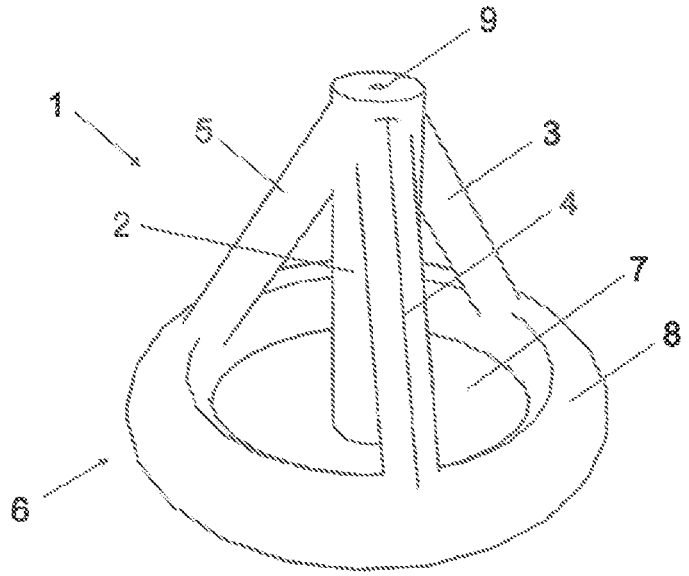
FIG. 1 shows an exemplary embodiment of a base according to the invention in a perspective view.

FIG. 1 shows an exemplary embodiment of a base 1 according to the invention in a perspective view. The base comprises an expanded central chamber 2 with an opening 9 arranged above for receiving an umbrella rod, which may be inserted into central chamber 2 in the longitudinal direction, so that central chamber 2 surrounds the rod. Central chamber 2 is held in the vertical alignment by expanded connecting chambers 3, 4, 5 designed as transverse struts. Connecting chambers 3, 4, 5 extend from the upper end of central chamber 2 to an expanded base chamber 8, which surrounds the lower end of central chamber 2 as a circular base ring. Base chamber 3 represents the lateral delimitation of a base element 6, which additionally has a floor mat 7, which covers the area delimited by base chamber 8. Floor mat 7 is connected water-tight to base chamber 8, so that the space, which is delimited laterally by base chamber 8 and from below by floor mat 7 may be filled with water. The water acts as a weight element, so that base chamber 8 and thus connecting chambers 3, 4, 5 remain in the depicted alignment—even with a rod inserted into central chamber 2—and may hold the inserted rod upright. Central chamber 2, connecting chambers 3, 4, 5, and base chamber 8 are configured as inflatable chambers, wherein the valve or the valves for inflating the chambers are not depicted.

Figure 2:
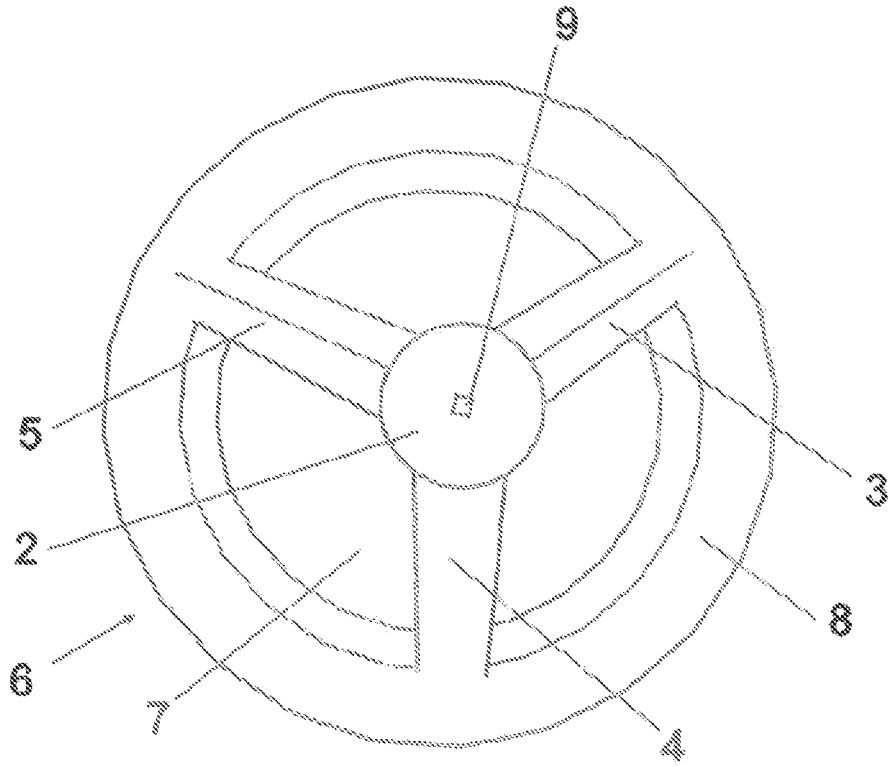
FIG. 2 shows an exemplary embodiment of a base according to the invention in a top view.

FIG. 2 shows an exemplary embodiment of a base 1 according to the invention in an expanded state in a top view. Base 1 comprises a central chamber 2, which is connected to three connecting chambers 3, 4, 5, wherein the lower ends of connecting chambers 3, 4, 5 are respectively connected to base chamber 8. Connecting chambers 3, 4, 5, are arranged distributed regularly circumferentially about central chamber 2, and extend radially from central chamber 2 to base chamber 8, when viewed from above. Central chamber 2 forms a sleeve, into which a rod may be inserted through opening 9. Base element 6 comprises, in addition to base chamber 8, a floor mat 7, which connects the lower end of the central chamber completely to base chamber 8.

Figure 3:
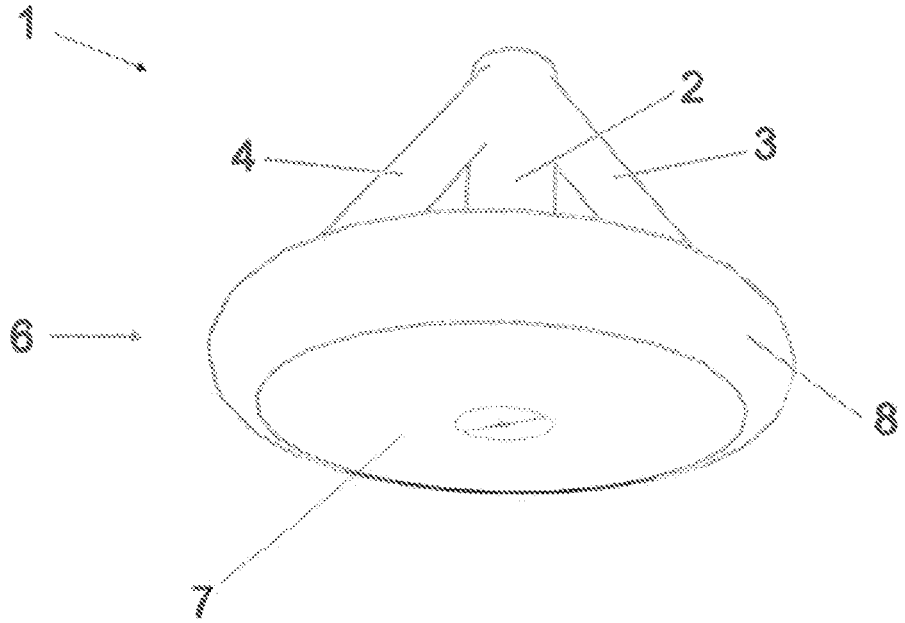
FIG. 3 shows an exemplary embodiment of a base according to the invention in a perspective view from below.

FIG. 3 shows an exemplary embodiment of a base 1 according to the invention in the expanded state in a perspective view from below. Base 1 comprises a base element 6 with a floor mat 7, which represents the lower end of base element 6, and at whose outer edge a base chamber 8 is arranged. Base 1 comprises a central chamber 2, whose lower end is sealed, wherein floor mat 7 is connected water-tight to central chamber 2. According to the invention, the lower end of central chamber 2 may also be sealed by floor mat 7.

Figure 4:
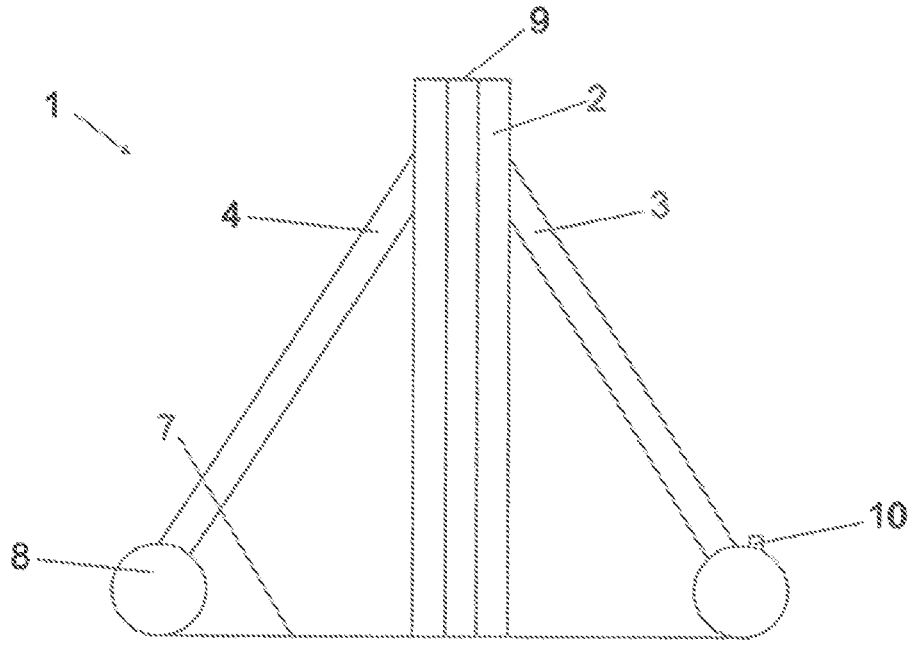
FIG. 4 shows a sectional depiction of an exemplary embodiment of a base according to the invention.

FIG. 4 shows a sectional depiction of an exemplary embodiment of a base 1 according to the invention in the inflated state. A central chamber 2 is arranged vertically and forms a sleeve, through whose opening 9 a rod may be inserted and pushed in up to floor mat 7. Central chamber 2 is connected to connecting chambers 3, 4, 5, which extend form central chamber 2 up to base chamber 8. Base chamber 8 is connected to floor mat 7 and surrounds the same along the circumference. Base chamber 8 comprises a valve 10, via which base chamber 8, and the additional inflatable chambers, may be inflated, or from which air may be discharged.

Figure 5:
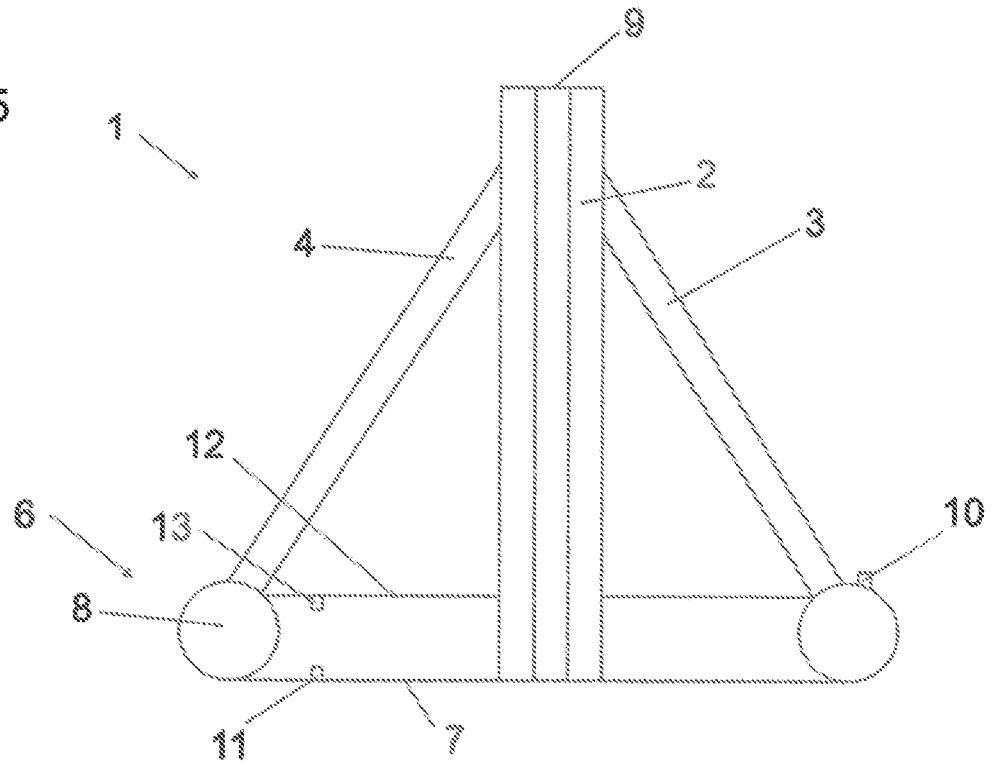
FIG. 5 shows a sectional depiction of an exemplary embodiment of a base according to the invention.

FIG. 5 shows a sectional depiction of an exemplary embodiment of a base 1 according to the invention in the inflated state. Base element 6 comprises a circumferential base chamber 8, a floor mat 7 arranged below, and a cover 12 arranged above floor mat 7. In this way, a cavity is formed between floor mat 7, base chamber 8, and cover 12, which may be filled or emptied via valves 11 and 13.

Figure 6:
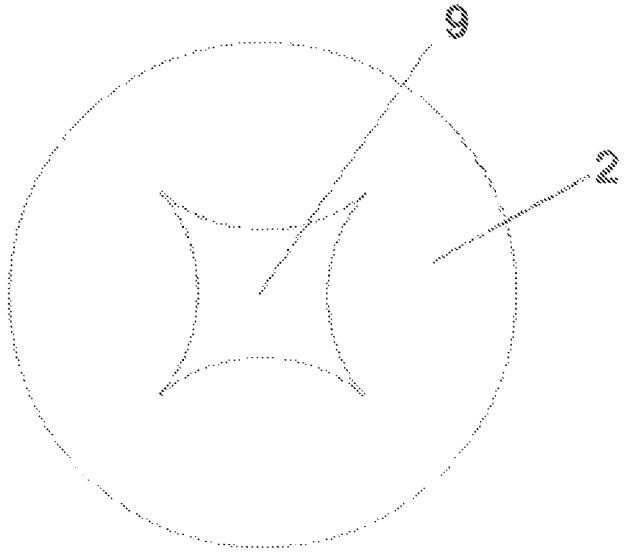
FIG. 6 shows an exemplary embodiment of a central chamber of a base according to the invention in a top view.

FIG. 6 shows an exemplary embodiment of a central chamber of a base 1 according to the invention in a top view. Central chamber 2 has a quadratic opening with semicircular indentations in the direction of the central opening. Such an opening enables the fixing of rods with diverse cross-sectional shapes and diverse cross-sectional sizes.

LIST OF REFERENCE NUMERALS

1) Base
2) Central chamber
3) Connecting chamber
4) Connecting chamber
5) Connecting chamber
6) Base element
7) Floor mat
8) Base chamber
9) Opening
10) Valve
11) Valve
12) Cover
13) Valve

The invention claimed is:

1. A base, comprising:

an expandable central chamber, which in the expanded state, forms a sleeve with an end, open at the top, configured to receive and securely hold a rod, a base element, at least one expandable connecting chamber which connects the central chamber to the base element, and wherein the central chamber comprises an elongate cylindrical body having an opening extending centrally and longitudinally from a top of the body to a bottom of the body.

2. The base according to claim 1, wherein the base comprises at least two expandable connecting chambers which respectively connect the central chamber to the base element.

3. The base according to claim 1, wherein the base element comprises an expandable base chamber.

4. The base according to claim 3, wherein the central chamber, the at least one expandable connecting chambers or and the base chamber form airtight chambers.

5. The base according to claim 3, wherein one, multiple, or all of the central chamber, the at least one expandable connecting chamber or the base chamber may be expanded by inflation.

6. The base according to claim 3, wherein the at least one expandable connecting chamber connects the expandable central chamber to the expandable base chamber.

7. The base according to claim 3, wherein the expandable base chamber and the at least one expandable connecting chamber form a continuous chamber.

8. The base according to claim 1, wherein the base element comprises a floor mat.

9. The base according to claim 1, wherein the at least one expandable connecting chamber is arranged distributed circumferentially about the central chamber.

10. The base according to claim 1, wherein the at least one expandable connecting chamber is at least half as long, in the expanded state, as the expandable central chamber in the expanded state.

11. The base according to claim 1, wherein the end of the central chamber opposite the open end is connected to the base element.

12. The base according to claim 1, wherein the end of the central chamber, open at the top, forms an opening, which, when viewed from the top, forms a slot, a circle, an oval, or a polygon.

13. The base according to claim 3, wherein the base element comprises a cover, thereby forming a cavity defined by a floor mat below and laterally by the base chamber.

14. The base according to claim 1, wherein the expandable central chamber forms a separate chamber.

15. The base according to claim 1, wherein the base element comprises an expandable base chamber which forms a base ring in the expanded state.

16. The base according to claim 1, wherein the base element comprises a floor mat comprising a ground sheet that is connected water-tight to the expandable base chamber.

17. The base according to claim 16, wherein the end of the central chamber opposite the open end is connected to the floor mat.

18. The base according to claim 1, wherein the connecting chambers are arranged distributed regularly circumferentially about the central chamber.

19. The base according to claim 1, wherein the end of the central chamber, open at the top, forms an opening, which, when viewed from the top, forms a triangle, square, pentagon, or hexagon, having sides that form semicircular indentations, in the direction of the center of the opening.

20. The base according to claim 1, wherein a bottom of the central cha tuber is sealed by a floor mat.

21. The base according to claim 1, wherein at least one expandable connecting chamber is at an angle from 20° to 60° with respect to a vertical axis of the central chamber.

22. The base according to claim 1, wherein the base element is weighted down with one or more weight elements.

* * * * *